US006669031B1

(12) United States Patent
Badonic

(10) Patent No.: US 6,669,031 B1
(45) Date of Patent: Dec. 30, 2003

(54) PLUG-IN ELASTIC HOLDER

(76) Inventor: Miroslav Badonic, Hlavna 15, Kosice (SK), 040 01

( * ) Notice: Subject to any disclaimer, the term of this patent is extended or adjusted under 35 U.S.C. 154(b) by 0 days.

(21) Appl. No.: 10/049,215

(22) PCT Filed: Aug. 14, 2000

(86) PCT No.: PCT/SK00/00013

§ 371 (c)(1),
(2), (4) Date: Mar. 13, 2002

(87) PCT Pub. No.: WO01/12046

PCT Pub. Date: Feb. 22, 2001

(30) Foreign Application Priority Data

Aug. 16, 1999 (SK) ..... PV 1115-99

(51) Int. Cl.[7] ..... A47F 5/00

(52) U.S. Cl. ..... 211/66; 211/89.01; 211/70.6; 248/316.2; 248/316.3

(58) Field of Search ..... 211/89.01, 66, 211/68, 70.6; 248/316.2, 316.3

(56) References Cited

U.S. PATENT DOCUMENTS

| | | | | |
|---|---|---|---|---|
| 56,377 A | * | 7/1866 | Cordis | |
| 3,096,960 A | * | 7/1963 | Kinney | |
| 3,365,761 A | * | 1/1968 | Kalvig | |
| 3,603,551 A | * | 9/1971 | Peterson | 211/89.01 X |
| 4,105,127 A | | 8/1978 | Holl | |
| 4,334,621 A | * | 6/1982 | Weber | 211/89.01 X |
| 4,544,351 A | | 10/1985 | Marsicano | |
| 4,905,951 A | * | 3/1990 | Putness | 211/89.01 X |
| 5,515,969 A | | 5/1996 | Schoenenbach | |

FOREIGN PATENT DOCUMENTS

| | | |
|---|---|---|
| DE | 3807208 | 9/1989 |
| EP | 0258047 | 3/1988 |
| WO | 9716103 A | 5/1997 |

* cited by examiner

*Primary Examiner*—Robert W. Gibson, Jr.
(74) *Attorney, Agent, or Firm*—Jordan and Hamburg LLP

(57) ABSTRACT

A holder for an article, especially a tooth brush, includes a holder body having on an inside wall thereof at least one oblong shaped resilient portion radially inwardly extending to the center portion of the holder body which upon insertion of the article into the holder exerts pressure on the article to hold the article or having at least one oblong shaped non-resilient portion embedded in an elastic portion ensuring the bending of the non-resilient portion. At a lower portion of the holder body a funnel shaped inlet hole is positioned for inserting of the article and at an upper portion of the holder body a surface having an attaching hole is positioned for fixing of the holder spatially.

19 Claims, 4 Drawing Sheets

PLUG-IN ELASTIC HOLDER

TECHNICAL FIELD

The invention refers to design of a holder for an article of daily use, especially for tooth-brush for holding of such articles in vertical downwards direction gripped at their stiff part, for example at a handle especially of small articles for daily use for example of cosmetiks pencils, lipsticks, combs and similar articles especially tooth-brushes, whereby the article, especially tooth-brush is pushed into holder from below upwards.

BACKGROUND ART

Till now for laying aside of daily use articles, especially of tooth-brushes goblets or small cases are used positioned on walls, boxes so that the tooth-brushes eventually other articles are put in these goblets or these are freely put aside. The disadvantage in this manner put aside daily use articles, especially tooth-brushes is that at bottom of the goblet or of the small box settle impurities. Further for holding of tooth-brushes holders with holes are used for placing the tooth-brushes inserted from above into these holes and hold on the border of the hole by means of own bristles, these are in direct contact with impurities settled on the holder body. Further articles especially articles for daily use, especially frequently used tooth-brushes are put aside in horizontal position on furniture or other furnishings or are inserted from above downwards into miscellaneous vessels positioned on walls or are freely put aside or hung up on miscellaneous racks, which is unpractical and unhygienic. Further the solution of a toothpaste tube holder is known presented in the specification of the patent application EPA 0258047. The toothpaste holder comprises a cylindrical housing having inwardly directed flat lamellas defining a circular hole and above lamellas a pad and a polymeric filler is positioned. The toothpaste is hanged up by the thread on the toothpaste tube and the necessary bias provide the pad and the polymeric filler, therefore the toothpaste tube is held by stiffness and not by the resilience of the lamellas. Taking out the toothpaste there is a danger of jamming of the lamellas on tube neck. and a difficult pulling out of the toothpaste can arise or the lamellas can be damaged. The described solution does not use a guide hole not even longitudinal resilient elements. The disadvantage of this design is that the lamellas must have in centre a precise defined circular opening, which must be smaller than the nech of the toothpaste tube in threaded portion. This holder is unsuitable for holding of other articles like toothpastes with precisely defined toothpaste tube neck diameter. As a further known solution the patent application WO97/16103 presents an universal holder for holding textile articles using an excentrically positioned cylinder equipped with inelastic clips. It is a different design designed for other application than described in filed invention application. A further published patent application DE 3807208 A1 discloses a presenting outfit for tools holding. The holder comprises a plate having a suspension slot and on lower portion of the slot is positioned a nose shaped element having a saddle as retaining element shaped like a convex bridge gripped at two points, which is in frictional engagement with the article, whereby the gripping of the aricle is complicated, because the gripped article must be first inserted into nose portion, and afterwards pushed into plate, especially in case of a heavier article it requires to take considerable force. Further the known design presented in U.S. Pat. No, 4,544,351 discloses a candle holder, in substance the candle is only supported in a glass or other container with bottom, so that the holder does not hold the candle but it is only supported by the holder, whereby the candle is inserted from above downwards. The U.S. Pat. No. 5,515,969 describes a holder for tools comprising a base surface juxtaposed with a countersurface, whereby the base surface being provided with an array of elastically deformable bristles on an artificial strip, it is in substance a zip-fastener. A further known design presented in U.S. Pat. No. 4,105,127 is a holder bar for supporting sheet-like articles or sheets of paper. The holder bar comprises a resilient hollow rod of rectangular cross section having a throughgoing insertion slot extending along the length dimension. The profile forms a clamp for receiving sheet-like articles introduced into the insertion slot.

SUMMARY OF THE INVENTION

The subject matter of the invention which removes the above mentioned wants is the constructional design of the holder for daily use article, especially tooth brush, holding these articles. downwards in vertical position which are gripped in upper part, especially of small articles for daily use, for example of tooth-brushes inserted from below upwards. The substance of the holder for daily use article, especially, tooth brush is that it comprises a holder body which in hollow on inside circumference is equiped with minimum one oblong shaped resilient portion, which after inserting the article, for example the tooth-brush handle bends and so arises a pressure between holder and tooth-brush handle. On lower part of the holder body a funnel-shaped inlet hole is positioned facilitating the insertion of held articles, especially tooth-brush. The upper portion of the holder body comprises a holder clamping surface or a holder hinge. Gripping of the daily use article, especially of the tooth-brush ensures one or more resilient portions in elongated holder body after inserting the daily use article, especially the tooth-brush handle through the inlet hollow from below upwards, whereby the tooth-bruch bristles bend down tending downwards and between the holder for daily use article, especially tooth-brush and holder body arises a pressure. The resilient oblong shaped portions are situated vertically to inside holder body wall tending to holder body middle. Alternatively also longitudinally to inner wall of the holder body bending the resilient portion in direction to axis of the inner hole on holder body. The oblong shaped resilient portions may be positioned on inner wall of the holder body or in holder body in vertical plane symmetrically or asymmetrically at different hights. The use of more resilient portions enables higher comfort for inserting and taking out, wider use and at the same time greater carrying capacity of the holder for articles with greater mass. Alternative conical design of the holder body or positioning of the resilient portions with different lengths ensures the use of one holder for holding of articles with different dimensions and shape. A further alternative of the holder for daily use article, especially tooth-bruch is that the oblong shaped resilient portion may be made stiff and the elasticity ensures its positioning into a resilient bed in holder body. The holder for daily use article, especially tooth-brush is used alone or grouped in varied units with different number of holders. The holder according to this invention enables wide use for holding of daily use articles, especially for tooth-brush with different shape, cross section and mass at higher hygienic standard.

DESCRIPTION OF THE SEVERAL VIEWS OF THE DRAWINGS

Figures make the invention nearly clear,

FIG. 5 illustrates the vertical section A—A of this holder.

BEST MODE FOR CARRYING OUT THE INVENTION

Example 1

Figure 1:
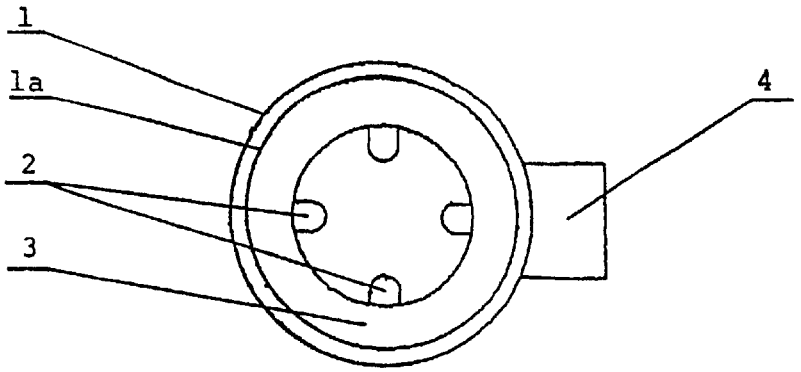
FIG. 1 illustrates the upon the lower portion of the holder for daily use article, especially tooth-brush with oblong shaped resilient portions vertically to wall of the holder body
Figure 1A:
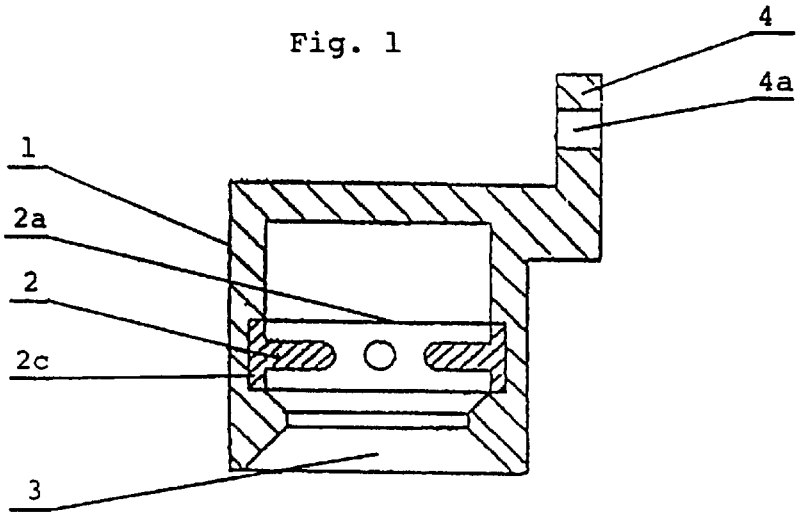
FIG. 1*a* illustrates the vertical sectional view A—A of this holder.
Figure 1B:
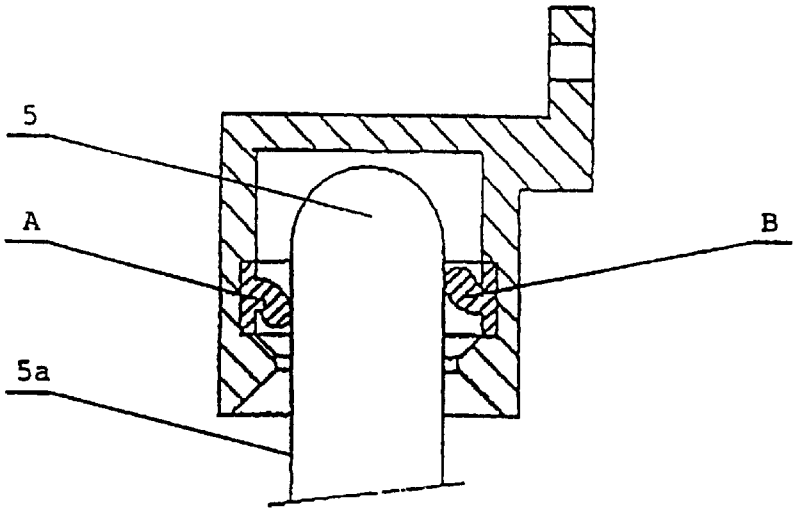
FIG. 1*b* illustrates the lateral vertical section of the holder for daily use article, especially tooth-brush with inserted handle of the held article, especially tooth-brush, whereby the position of the resilient portion B is illustrated during insertion and the position A illustrates the condition of the resilient portion at taking out the held article.

The holder for daily use article, especially tooth-brush according to invention in concrete example illustrated in FIGS. 1, 1*a* and 1*b* comprises a holder body 1, wherein its lower portion comprises a funnel-shaped inlet hole 3 for facilitating the introducing of inserted articles and the upper portion of the holder body 1 is the clamping surface 4 having the hollow 4*a* for spacial fixing of the holder for example on wall or on a box. On inner wall 1*a* of the holder body in slot 2*c* the ring 2*a* is positoned with four resilient portions 2 spaced by 90°. The ring 2*a* and the oblong shaped resilient portion 2 are made of rubber, silicone or other suitable material as one unit.

To grip the article for example tooth-brush 5 in the holder the handle 5*a* of the tooth-brush is inserted through funnel shaped inlet hollow 3 from below upwards into holder body 1, whereby the bristles of the tooth-brush 5 tend downwards. After inserting the handle 5*a* of the tooth-brush it is held in holder by oblong shaped resilient portions 2. The held article is drawn out from holder by drawing downwards.

Example 2

Figure 2:
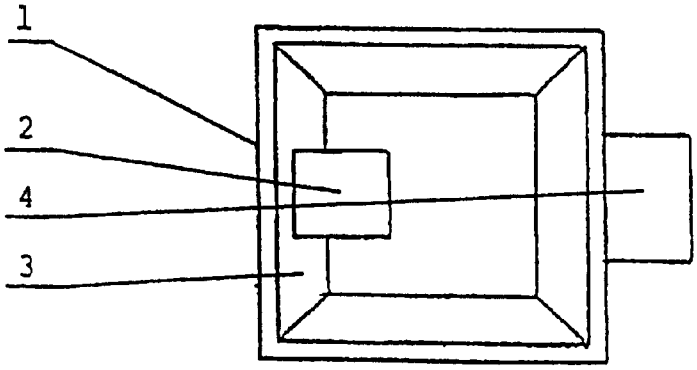
FIG. 2 illustrates the view to lower portion of the holder for daily use article, especially tooth-brush with resilient portion positioned longitudinal to holder body wall.
Figure 2A:
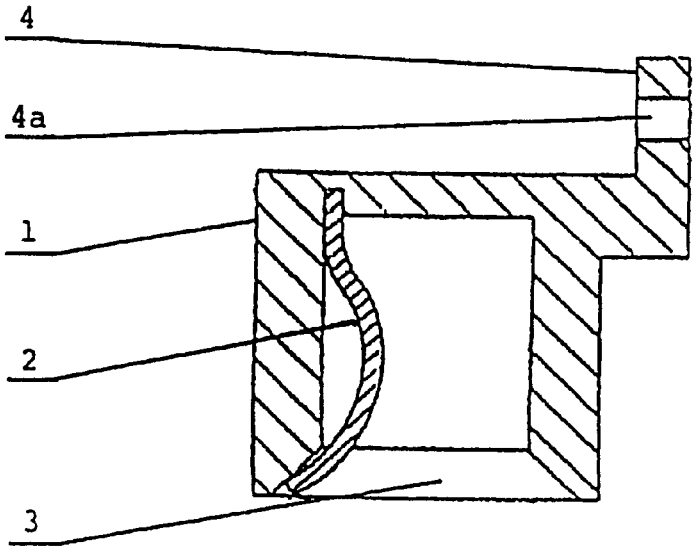
FIG. 2*a* illustrates the vertical sectional view B—B of this holder.
Figure 2B:
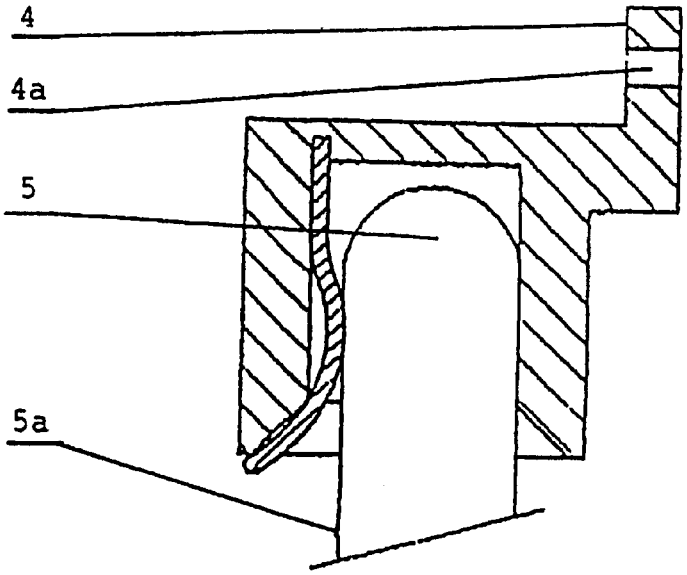
FIG. 2*b* illustrates the lateral vertical section of the holder for daily use article, especially tooth-brush, presenting the longitudinal resilient portion with inserted handle of the held article, especially of a tooth-brush.

The holder for daily use article, especially tooth-brush according to invention in concrete example illustrated in FIGS. 2, 2*a* and 2*b* comprises a holder body 1, whereby in its lower portion a funnel shaped inlet hollow 3 is made for facilitating the introducing of inserted articles and in upper portion of the holder body 1 the clamping surface 4 is positioned with the hole 4*a* for spacial fixing of the holder and on inner wall 1*a* of the holder body is positioned the oblong shaped longitudinal resilient portion 2 deviating in direction to axis of the holder 1. Inserting the handle 5*a* of a tooth-brush the longitudinal resilient portion 2 bends and presses on the handle 5*a* of the tooth-brush.

The holder for daily use article, especially tooth-brush is fastened on wall, furniture or other basis with fastening element through hole 4*a*. The method and manipulation at inserting and drawing out the held articles is similar to example 1.

Example 3

Figure 3:
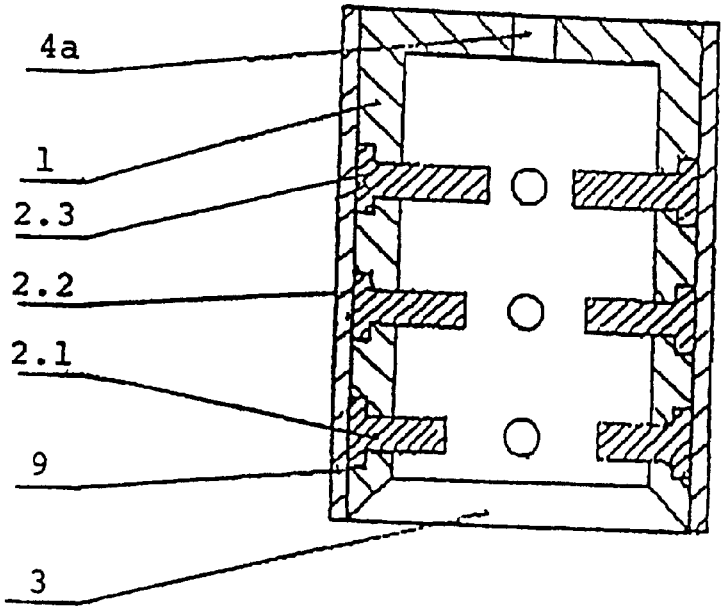
FIG. 3 illustrates the holder in lateral section with different resilient portion lengths and FIG. 4 illustrates the lateral section of the conical holder.

The holder for daily use article, especially tooth-brush according to invention in concrete example illustrated in FIG. 3 comprises a holder body 1, whereby in its lower portiuon is positioned the funnel shaped inlet hole 3 and in upper portion of the holder to body 1 is the clamping hole 4*a* and in wall of holder body 1 vertically in three levels are positioned the resilient portions 2.1, 2.2, 2.3, whereby the resilient portions 2.1 are shorter than the resilient portions 2.2 and the resilient portions 2.2 are shorter than the resilient portions 2.3. On holder body 1 on side walls of the holder body 1 outsidely is positioned the cover 9, which hinders pushing out of resilient portions 2.1, 2.2, 2.3 from holder body 1.

In this manner made holder enables holding of articles with different dimensions and forms. The method and manipulation at inserting and drawing out the held articles is similar to example 1.

Example 4

Figure 4:
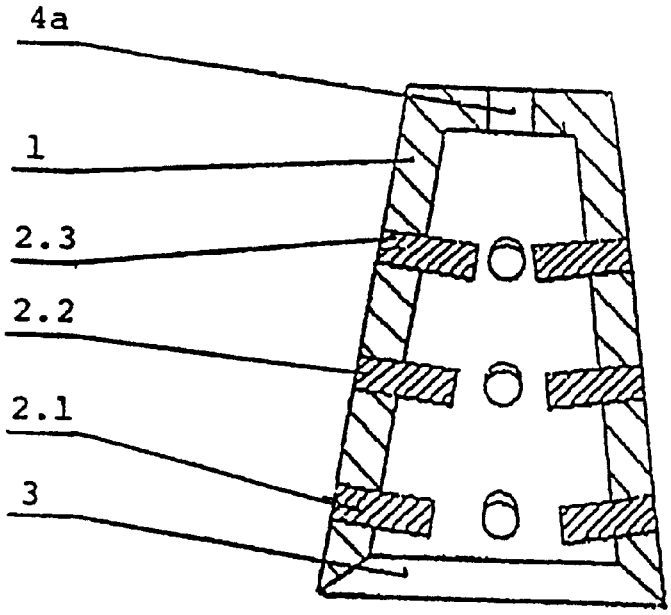

The holder for daily use article, especially tooth-brush according to invention in concrete example illustrated in FIG. 4 comprises a holder body 1, which is conically shaped with resilient portions 2.1, 2.2, 2.3, which have the same length and are positioned in three hight levels on inner circumference of the holder body 1, whereby in its lower portion is the funnel shaped inlet hole 3 and in upper portion of the holder body 1 is the gripping hole (4*a*).

In this manner made holder enables holding of articles with different dimensions. The method and manipulation at inserting and drawing out of held articles is similar to example 1.

Example 5

Figure 5:
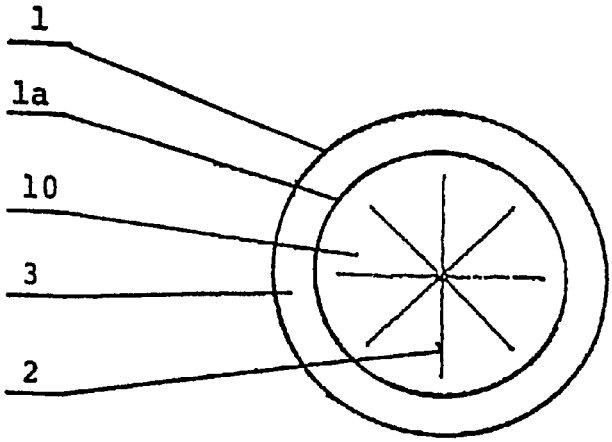
FIG. 5 illustrates the view from below of the holder for daily use article, especially tooth-brush with membrane gripping element cross-slitted through its centre
Figure 5A:
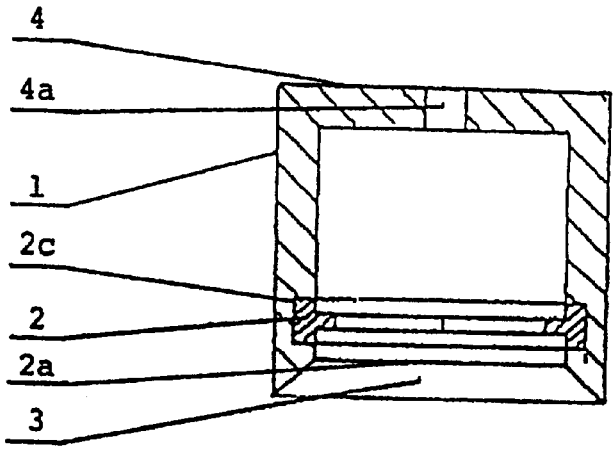

The holder for article of daily use, especially for tooth-brush according to invention in concrete example illustrated in FIG. 5 comprises a holder body 1, whereby in its lower portion is positioned the funnel shaped inlet hole 3 and in upper portion of the holder body 1 is positioned the clamping surface 4 with hole 4*a* for holder fixing. Further on inner wall of the holder body 1 in slot 2*c* is positioned the membrane ring 2*a*, which is cross-slitted through centre with four cuts creating eight resilient portions 2. The ring 2*a* and the resilient portions 2 as one whole are membrane shaped made of made of rubber, silicone or other suitable material.

The method and manipulation at inserting and drawing out the held articles is similar to example 1.

Example 6

Figure 6:
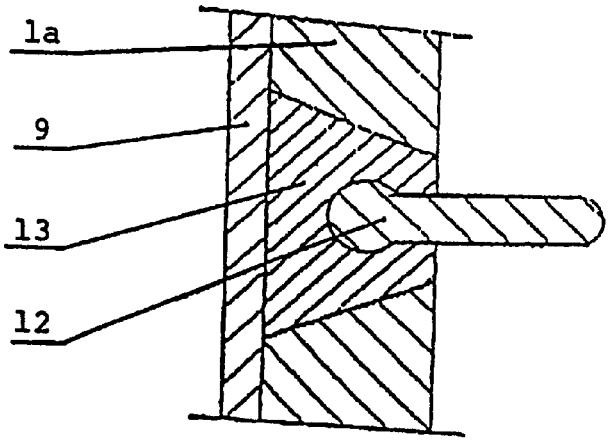
FIG. 6 illustrates detail of the resilient gripping bed, in which a stiff portion is positioned, whereby the stiff portion positioned in resilient bed ensures the pressure between holder and held article.

The holder for daily use article, especially tooth-brush according to invention in concrete example illustrated in FIG. 6 comprises a holder body 1, whereby on inner wall 1*a* of the holder body the elastic bed 13 is positioned in which the oblong shaped stiff portion 12 is bedded The holder body 1 has on outer side the cover 9, which hinders pushing out of the elastic bed 13 from holder body 1.

The method and manipulation at inserting and drawing out the held articles is similar to example 1.

INDUSTRIAL UTILIZABILITY

The holder for daily use article, especially tooth-brush is well applicable in single part production and also in series production and is utilizable everywhere where is necessary hygienic holding of articles for daily use like cosmetics pencils, paiunts, but especially tooth-brushes with different shaped handle cross sections in vertical position with upper gripping of the stiff portion of the article, whereby the held articles are inserted from below upwards.

What is claimed is:

1. A holder for an article of daily use, comprising:

a holder body having an inside wall; and at least one oblong shaped portion extending radially inwardly into a center of the holder body which is resiliently deflected after inserting the article into said holder body, thereby producing pressure on the article and holding the article in said holder body, a lower portion of the holder body defining a funnel shaped inlet hole being positioned for inserting the article to be held.

2. A holder according to claim 1, wherein an upper portion of said holder body includes a portion having an attaching hole for mounting the holder to a support.

3. A holder according to claim 1, wherein said oblong shaped portion is positioned on the inside wall of the holder body at an upper portion thereof, a second end of the resilient portion extending into a margin portion of the funnel shaped inlet hole.

4. A holder according to claim 1, wherein said at least one oblong shaped portion is defined by a complete ring which is at least once longitudinally cross-slitted.

5. A holder according to claim 4, wherein said inside wall of the holder body includes a slot for positioning of said ring having the at least one said oblong shaped portion.

6. A holder according to claim 1, wherein said inside wall of the holder body includes, at least in two different levels, oblong shaped resilient portions, said holder body being conical in shape.

7. A holder for an article of daily use, comprising:

a holder body having an inside wall; and at least one oblong shaped portion extending radially inwardly into a center of the holder body which is resiliently deflected after inserting the article into said holder body, thereby producing pressure on the article and holding the article in said holder body, a lower portion of the holder body defining a funnel shaped inlet hole being positioned for inserting the article to be held, said at least one oblong shaped portion including, at least in two different levels, oblong shaped resilient portions, wherein said oblong shaped resilient portions are shorter at a lower level of said different levels than at a higher level thereof; and side walls of said holder body include a cover hindering a pressing out of the resilient portions from said holder body.

8. A holder according to any one of claims 1 to 7, wherein said holder includes more holders ranged close to one another or one behind the other into a unit.

9. A holder for an article of daily use, comprising:

a holder body of hollow configuration presenting an inside wall defining an interior of said holder body, said interior being suitably configured for receiving a portion of the article therein inserted through an entry to said interior, said entry to said interior including a funnel shaped opening at said entry to facilitate insertion of said article therein; and at least one engaging member extending from said inside wall radially inward of the interior of said holder body, at least a portion of said at least one engaging member being resiliently deflected by insertion of the portion of the article into the interior of said holder body in a manner producing pressure on the article for holding the article in said holder body.

10. A holder according to claim 9, wherein a portion of said holder body includes mounting structure for mounting the holder to a support.

11. A holder according to claim 9, wherein said entry is located in a lower position of said holder body, said at least one engaging member being attached to said holder body at an upper portion of the interior of said holder body and extends into a margin portion of the funnel shaped opening, said at least one engaging member being resiliently deformable and bowing inwardly of said interior prior to insertion of the article.

12. A holder according to claim 9, wherein said at least one engaging member is defined by a ring shaped structure which is at least once longitudinally cross-slitted.

13. A holder according to claim 12, wherein said inside wall of the holder body includes a slot for positioning said ring shaped structure.

14. A holder according to claim 9, wherein:

said at least one engaging members include at least two engaging members which are disposed in at least two different levels along said inside wall of the holder body and which extend inwardly from respective bases thereof to respective terminal ends.

15. A holder according to claim 14, wherein said interior of said holder body is conical in shape and tapering away from said entry.

16. A holder according to claim 14, wherein said at least two engaging members are shorter at a lower level of said at least two different levels than at a higher level thereof.

17. A holder according to claim 14, further comprising a cover which is received about the holder body, hindering a pressing out of the at least two engaging members from said holder body.

18. A holder according to claim 14, wherein said at least two engaging members are downwardly angled from said bases to said terminal ends thereof.

19. A holder according to claim 9, wherein said at least one engaging member includes a stiff engagement portion which is embedded at a base thereof in a resilient bed.

* * * * *